US011077381B1

(12) United States Patent
Huisman et al.

(10) Patent No.: US 11,077,381 B1
(45) Date of Patent: Aug. 3, 2021

(54) WHEEL FOR A TOY CAR

(71) Applicant: TOMY International, Inc., Oak Brook, IL (US)

(72) Inventors: Christopher Huisman, Dyersville, IA (US); Jeremy Shank, Farley, IA (US); Jared Kreuzer, Deerfield, IL (US); Travis Hoy, La Porte City, IA (US)

(73) Assignee: TOMY INTERNATIONAL, INC., Oak Brook, IL (US)

( * ) Notice: Subject to any disclaimer, the term of this patent is extended or adjusted under 35 U.S.C. 154(b) by 0 days.

(21) Appl. No.: 15/931,348

(22) Filed: May 13, 2020

(51) Int. Cl.
*A63H 17/00* (2006.01)
*A63H 17/26* (2006.01)

(52) U.S. Cl.
CPC ..... *A63H 17/262* (2013.01)

(58) Field of Classification Search
CPC ..... A63H 17/00; A63H 17/262; A63C 17/22; A63C 17/223; A63C 17/24
See application file for complete search history.

(56) References Cited

U.S. PATENT DOCUMENTS 3,611,630 A * 10/1971 Adickes et al. ..... A63H 17/262 446/469
3,638,356 A * 2/1972 La Branche ..... A63H 17/262 446/465
3,934,632 A * 1/1976 Kalpin ..... B60C 11/00 152/210
5,373,791 A * 12/1994 Bach ..... A63H 17/262 104/288
5,971,496 A * 10/1999 Duning ..... B60B 3/165 301/35.626
D418,890 S 1/2000 Wilson
D489,110 S 4/2004 Carlson
6,767,071 B2 * 7/2004 Cai ..... B23K 20/129 301/132
8,696,402 B2 * 4/2014 Robins ..... A63H 29/18 446/459
9,931,580 B2 * 4/2018 Rehkemper ..... A63H 17/008
2011/0095598 A1 * 4/2011 Hooven ..... A63C 17/226 301/108.5
2011/0177755 A1 * 7/2011 Nakayama ..... A63H 17/262 446/470

OTHER PUBLICATIONS

Video,"Guidance by Railway Tracks" Open Educational Resources Initiative by the Faculty of Civil Engineering of the RWTH Aachen University, Germany, viewed at: https://laughingsquid.com/why-train-wheels-require-rigid-conical-shape/https://youtu.be/vkzgcJGdUnA.

* cited by examiner

*Primary Examiner* — John A Ricci
(74) *Attorney, Agent, or Firm* — Husch Blackwell LLP

(57) ABSTRACT

A wheel for a toy car can include a cylindrical portion and a conical portion, where a first width of the cylindrical portion is narrower than a second width of the conical portion.

19 Claims, 3 Drawing Sheets

WHEEL FOR A TOY CAR

FIELD

The present disclosure relates generally to wheels on a vehicle, and more particularly, to toy car wheels.

BACKGROUND

Toy cars provide amusement for children and adult alike. A toy car may be modeled after an actual, and often exotic, automobile, such as a sedan, a truck, a racing car, and an off-road vehicle. Alternatively, a toy car may depict a fictitious car of various designs.

Some toy cars are designed to be racing cars. For example, a plurality of these toy cars race against one another, or compete to set a best time, a best distance, or some other parameter.

Propulsion for such toy cars can be achieved through spring wound motors, electrical motors, inertia wheel driven propulsion motors, or other propulsion mechanisms generally known in the art. Commonly, toy cars gain potential energy by being pulled backwards by a user causing the wheels to turn in a reverse direction, and after gaining the potential energy, propulsion drives the car forward.

Better performing toy cars are desirable for enhanced amusement values, as added speed may increase the excitement of playing with such toy cars. Additionally, toy cars capable of propelling forward for a longer distance also provided greater entertainment and amusement for children. As such, there is an ongoing need for toy cars with better performance characteristics, such as traveling further or faster.

SUMMARY

Exemplary embodiments disclosed herein relate to a wheel for a toy car that can provide the toy car with enhanced performance characteristics.

According to one embodiment, a wheel can include a conical portion and a cylindrical portion, where a first width of the cylindrical portion is narrower than a second width of the conical portion.

According to another embodiment, a wheel and axle system can include an axle and at least one wheel comprising a conical portion and a cylindrical portion, where the wheel can couple to the axle and where a first width of the cylindrical portion can be narrower than a second width of the conical portion.

According to another embodiment, a toy car can include a chassis, a first axle that can engage the chassis, and at least one conical wheel coupled to the first axle comprising a conical portion and a cylindrical portion, where a first width of the cylindrical portion can be narrower than a second width of the conical portion.

BRIEF DESCRIPTION OF THE DRAWINGS

The accompanying drawings illustrate the present invention and together with the description, further serve to explain the principles of the invention and to enable a person skilled in the relevant art to make and use the invention.

Figure 1:
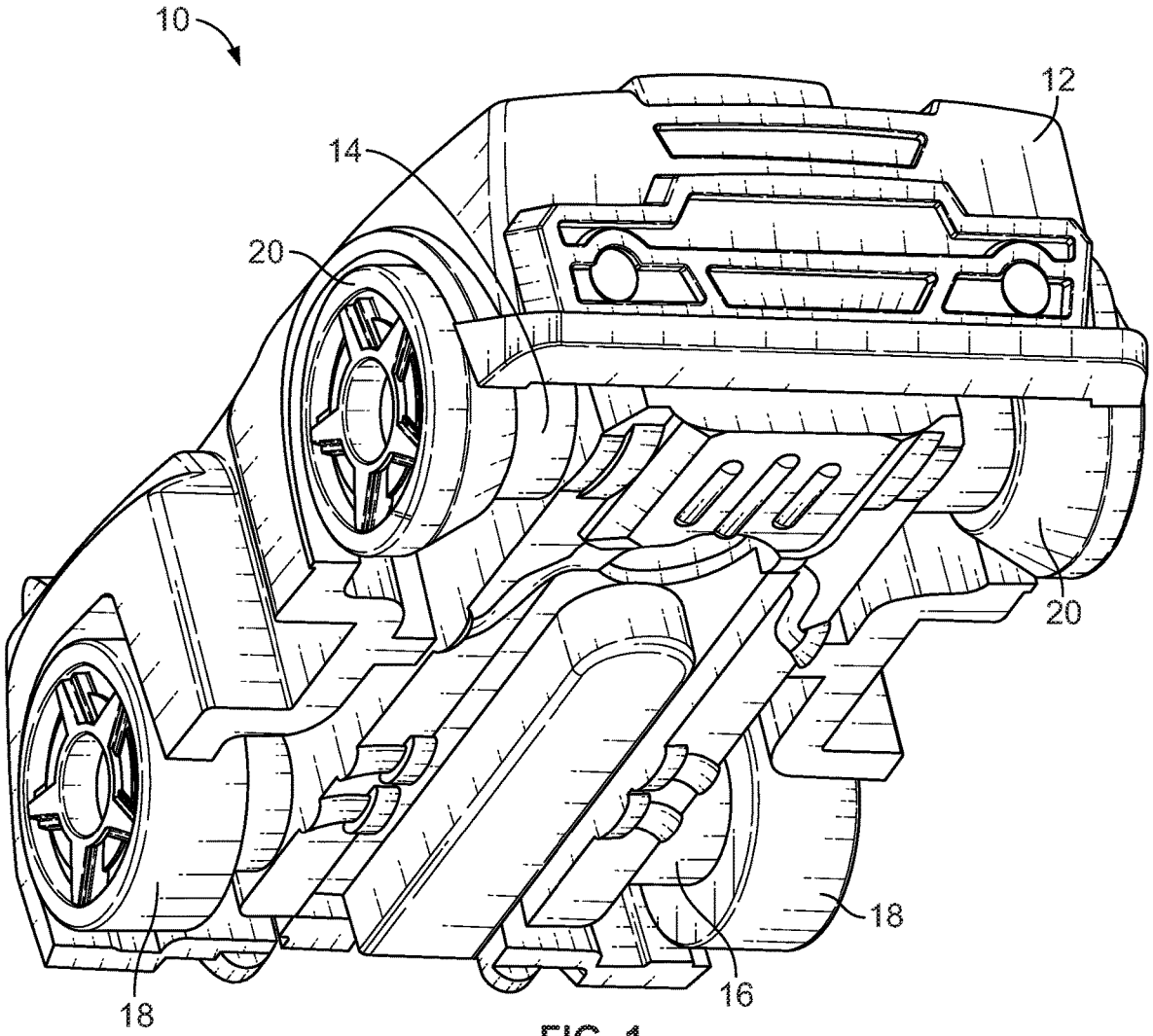
FIG. 1 is a perspective view of a toy car equipped with a wheel, according to an exemplary embodiment.

Before explaining the embodiments of the present disclosure in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

While this invention is susceptible of embodiments in many different forms, there are shown in the drawings and will be described in detail herein specific embodiments with the understanding that the present disclosure is to be considered as an exemplification of the principles of the invention. It is not intended to limit the invention to the specific illustrated embodiment.

The features of the invention disclosed herein in the description, drawings, and claims can be significant, both individually and in any desired combinations, for the operation of the invention in its various embodiments. Features from one embodiment can be used in other embodiments of the invention.

Exemplary embodiments described herein include a wheel for a toy car having a conical portion and a cylindrical portion, where a first width of the cylindrical portion is narrower than a second width of the conical portion.

Figure 2:
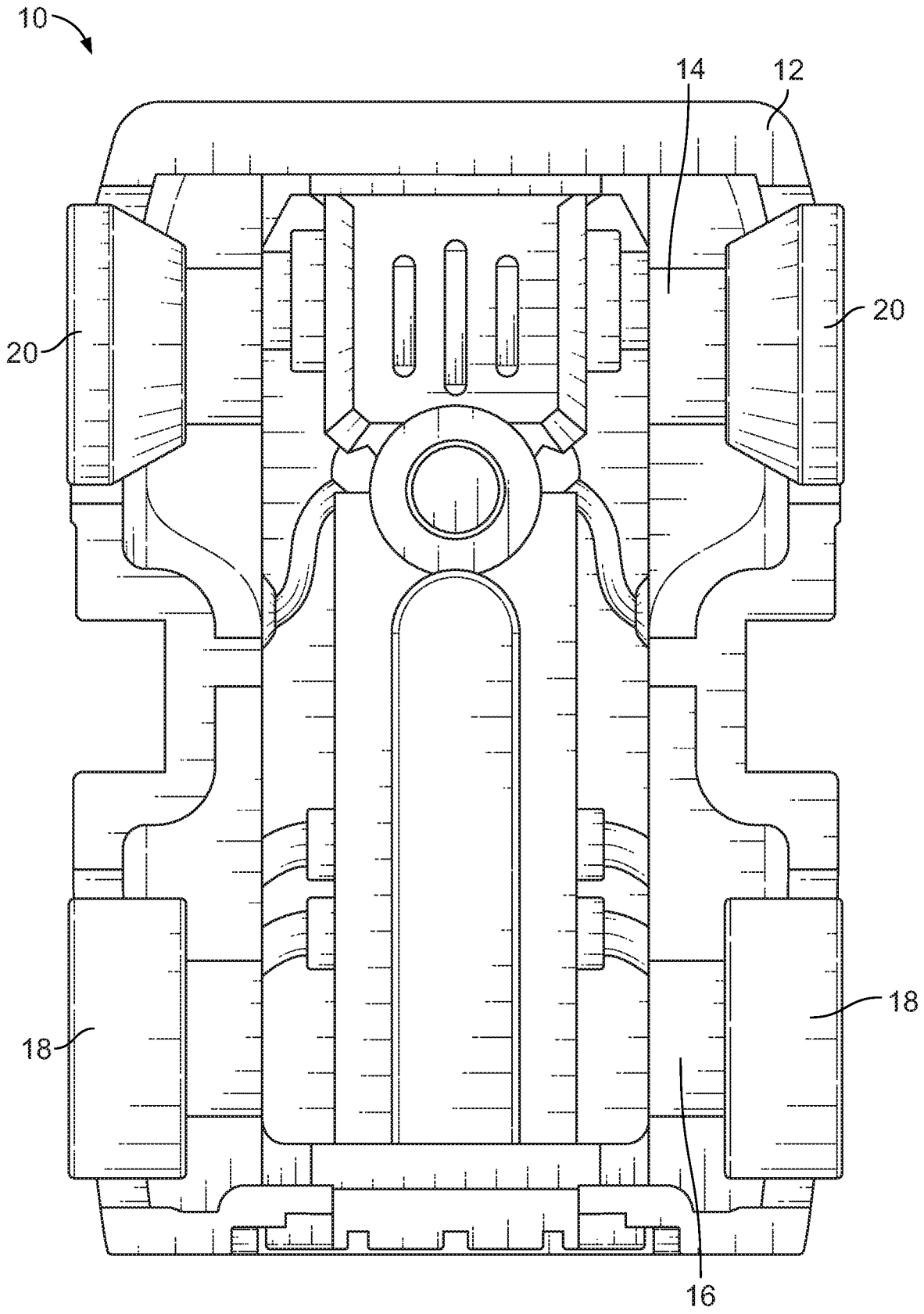
FIG. 2 is a bottom view of the toy car of FIG. 1 equipped with the wheel, according to an exemplary embodiment.

Referring generally to FIGS. 1 and 2, a toy car 10 can include a chassis 12, a front axle 14, a rear axle 16, rear wheels 18, and front wheels 20. In one embodiment, the front axle 14 may run through the entire chassis 12 to couple to both front wheels 20, and the rear axle 16 may run through the entire chassis 12 to couple to both rear wheels 18. Alternatively, each wheel of the front and rear wheels 18, 20 may engage to its own axle, each of which is then engaged to the chassis 12. Thus, the toy car 10 may have two axles, four axles, or any other numbers of axles. For example, a toy car depicting a semi-truck may include more axles than a toy car depicting a sedan. Likewise, for example, the toy car 10 may depict a sport car having four wheels, a roadster having three-wheels, a tractor-trailer having more than four wheels, or any other vehicle having any number of wheels. Alternatively, in some embodiments, the toy car may omit axles, such as in a motorcycle or bicycle embodiment.

Importantly, and as shown in FIG. 1, the front wheel 20 or each of the front wheels 20 can have a conic shape such that a portion of the wheel is cylindrical, and a portion of the wheel is conic. A front wheel of this configuration can decrease an amount of surface area contact between the front wheel 20 and a surface (e.g. ground, road, track, etc.).

According to an exemplary embodiment, as shown by FIGS. 1 and 2, the front wheels 20 may be conical wheels, and the back wheels may be conventional, cylindrical wheels. According to an exemplary embodiment, conventional cylindrical wheels may couple to a propulsion mechanism (e.g. through an axle), and while conical wheels may not couple to the propulsion mechanism.

Figure 3:
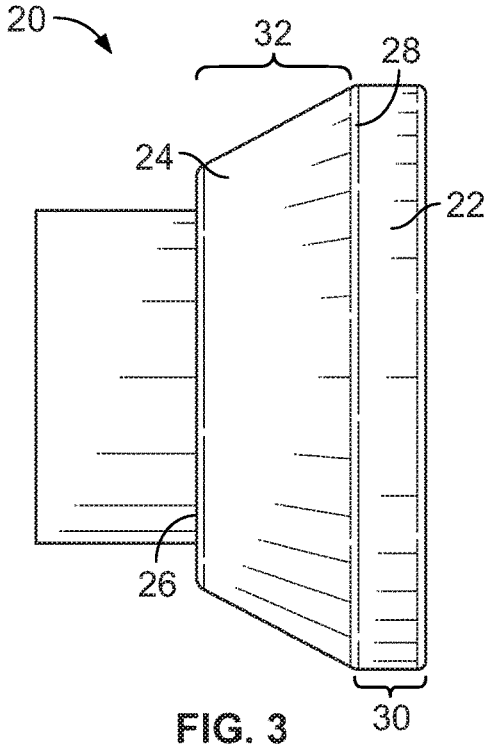
FIG. 3 is a side view of the wheel for a toy car, according to an exemplary embodiment.
Figure 4:
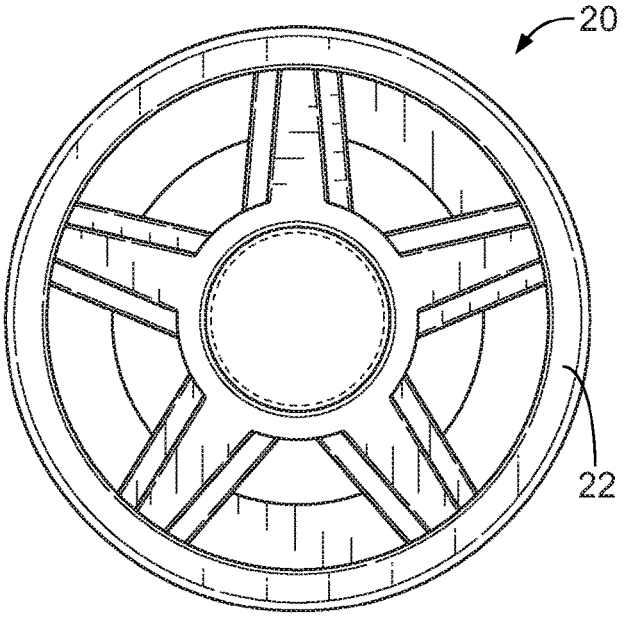
FIG. 4 is a front view of the wheel for a toy car, according to an exemplary embodiment.
Figure 5:
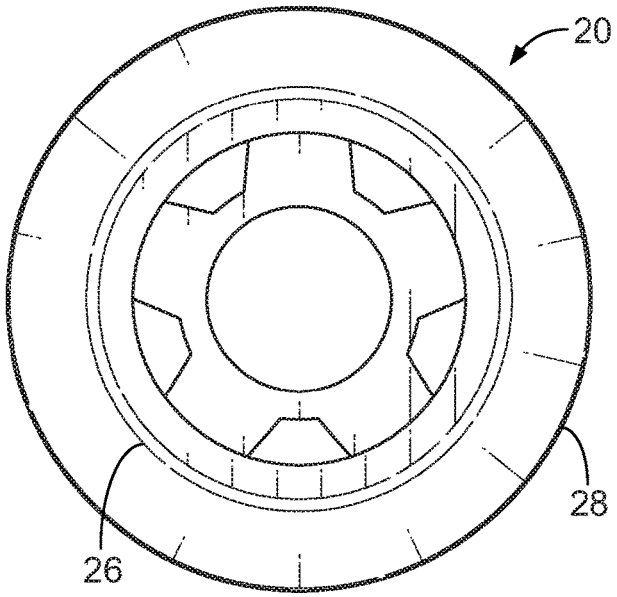
FIG. 5 is a rear view of the wheel for a toy car, according to an exemplary embodiment.

Referring generally to FIGS. 3-5, the conical wheel 20 may include a cylindrical portion 22 and a conical portion 24. Moreover, the conical portion 24 further includes a first end 26 and a second end 28, where the first end 26 has a circumference smaller than a circumference of the second end 28. Furthermore, any first location on the conical portion 24 closer to the second end 28 may have a larger circumference that any second location on the conical portion 24 closer to the first end 26 (i.e. conical in shape). Meanwhile, the cylindrical portion 22 may have the same or similar circumference at most or all locations of the cylindrical portion 22 (i.e. cylindrical in shape). In some embodiments, the conical portion 24 may be positioned closer to the central axis of the car 10 than the cylindrical portion 22 (see FIGS. 1 and 2).

As shown in FIG. 3, according to an exemplary embodiment, a first width 30 of the cylindrical portion 22 is narrower than a second width 32 of the conical portion 24. By reducing the first width 30 of the cylindrical portion 22 of the wheel 20, the mass of the wheel 20 is thereby reduced as opposed to a wholly cylindrical wheel found in conventional toy cars.

Given that reducing mass also reduces the moment of inertia in a rotating system, the amount of torque needed for a desired angular acceleration about a rotational axis can be reduced by utilizing a wheel with less mass. As such, a toy car equipped with conical wheels can travel further and/or faster than a similar toy car having conventional, cylindrical wheels.

According to an embodiment, the first width 30 of the cylindrical portion 22 may be less than 50% of the overall width of the wheel 20. In an alternative embodiment, the first width 30 of the cylindrical portion 22 may be less than 33% of the overall width of the wheel 20. In yet another embodiment, the first width 30 of the cylindrical portion 22 may be less than 25% of the overall width of the wheel 20. In yet a further embodiment, the first width 30 of the cylindrical portion 22 may be less than 10% of the overall width of the wheel 20.

Alternatively, the first width 30 of the cylindrical portion 22 may be expressed as a ratio of the second width 32 of the conical portion 24. According to an embodiment, the first width 30 of the cylindrical portion 22 may be less than 50% of the second width 32 of the conical portion 24. In an alternative embodiment, the first width 30 of the cylindrical portion 22 may be less than 33% of the second width 32 of the conical portion 24. In yet another embodiment, the first width 30 of the cylindrical portion 22 may be less than 25% of the second width 32 of the conical portion 24. In a further embodiment, the first width 30 of the cylindrical portion 22 may be less than 10% of the second width 32 of the conical portion 24.

A specific width of the cylindrical portion 30 may be dictated based on numerous factors. For example, certain toy cars may be more suitable to be used on a track as opposed to on an open surface or on a rough surface. It may be desirable to decrease the first width 30 of the cylindrical portion 22 when the stability of the toy car 10 equipped with conical wheels 20 is less of a concern, such as when the toy car 10 is designed to be played on a track.

From the foregoing, it will be seen that the various embodiments of the present invention are well adapted to attain all the objectives and advantages hereinabove set forth together with still other advantages. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required."

Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A toy car, comprising:

a chassis;

a first axle that engages the chassis; and at least one conical wheel coupled to the first axle comprising a conical portion and a cylindrical portion, wherein a first width of the cylindrical portion is narrower than a second width of the conical portion, wherein the conical portion further comprising a first end and a second end, wherein the second end abuts the cylindrical portion, wherein the first end has a circumference smaller than the second end, and wherein the first end is located closer to a central axis of the toy car than the second end.

2. The toy car of claim 1, wherein the first width of the cylindrical portion is less than 50% of a width of the conical wheel.

3. The toy car of claim 1, wherein the first width of the cylindrical portion is less than 33% of a width of the conical wheel.

4. The toy car of claim 1, wherein the first width of the cylindrical portion is less than 25% of a width of the conical wheel.

5. The toy car of claim 1, wherein the first width of the cylindrical portion is less than 10% of a width of the conical wheel.

6. The toy car of claim 1, wherein the first width of the cylindrical portion is less than 50% of the second width of the conical portion.

7. The toy car of claim 1, wherein the first width of the cylindrical portion is less than 33% of the second width of the conical portion.

8. The toy car of claim 1, wherein the first width of the cylindrical portion is less than 25% of the second width of the conical portion.

9. The toy car of claim 1, wherein the first width of the cylindrical portion is less than 10% of the second width of the conical portion.

10. The toy car of claim 1, further comprising:

a second axle;

at least one cylindrical wheel coupled to the second axle; and a propulsion system configured to propel the toy car, wherein the second axle couples to the propulsion system.

11. A toy car, comprising:

a chassis;

a first axle that engages the chassis;

at least one conical wheel coupled to the first axle comprising a conical portion and a cylindrical portion;

a second axle;

at least one cylindrical wheel; and a propulsion system configured to propel the toy car, wherein the second axle couples to the propulsion system, and wherein a first width of the cylindrical portion is narrower than a second width of the conical portion.

12. The toy car of claim 11, wherein the first width of the cylindrical portion is less than 50% of a width of the conical wheel.

13. The toy car of claim 11, wherein the first width of the cylindrical portion is less than 33% of a width of the conical wheel.

14. The toy car of claim 11, wherein the first width of the cylindrical portion is less than 25% of a width of the conical wheel.

15. The toy car of claim 11, wherein the first width of the cylindrical portion is less than 10% of a width of the conical wheel.

16. The toy car of claim 11, wherein the first width of the cylindrical portion is less than 50% of the second width of the conical portion.

17. The toy car of claim 11, wherein the first width of the cylindrical portion is less than 33% of the second width of the conical portion.

18. The toy car of claim 11, wherein the first width of the cylindrical portion is less than 25% of the second width of the conical portion.

19. The toy car of claim 11, wherein the first width of the cylindrical portion is less than 10% of the second width of the conical portion.

* * * * *